United States Patent [19]

Blum

[11] Patent Number: 4,490,916

[45] Date of Patent: Jan. 1, 1985

[54] TEMPLATE FOR SCRIBING POLYGONS

[76] Inventor: Herman D. Blum, 131 Cindy Dr., Old Bridge, N.J. 08857

[21] Appl. No.: 458,215

[22] Filed: Jan. 17, 1983

[51] Int. Cl.[3] ..... B43L 13/00

[52] U.S. Cl. ..... 33/174 B; 33/482

[58] Field of Search ..... 33/174 B, 174 G, 1 F, 33/482, 476, 479, 1 AP, 1 N

[56] References Cited

U.S. PATENT DOCUMENTS

| | | | |
|---|---|---|---|
| 757,246 | 4/1904 | Ablett | 33/482 |
| 1,600,666 | 9/1926 | Dugan | 33/482 |
| 2,713,207 | 7/1955 | Nielsen | 33/479 |
| 3,795,053 | 3/1974 | Burke | 33/174 B |

FOREIGN PATENT DOCUMENTS

| | | | |
|---|---|---|---|
| 883508 | 7/1953 | Fed. Rep. of Germany | 33/174 B |

*Primary Examiner*—Willis Little

[57] ABSTRACT

There is disclosed a template for providing multi-sided figures such as figures having 5, 6, or more sides.

Essentially, the template is a planar member having a bottom apex. Directed from the apex, at a given angle, with respect to the horizontal, are two sides each of opposite slope. The member has a central vertical axis which is directed from the bottom apex and along which are a series of indicators spaced according to a desired length of a side. Positioned on the planar member are two slots which are parallel to the sloping sides emanating from the apex. Each indicator along the vertical axis is manifested by lines which are drawn from the indicator to the corresponding slot. In order to construct a polygon, the user emplaces a tack or pin through an indicator of the central axis to determine the length of the side and then marks the surface upon which the polygon is to be drawn by imprinting a mark where the connecting indicator line intersects the slot.

A first corner is then scribed by marking two lines on either side of the apex. The unit is then rotated in position until a mark corresponds with a line on the opposing side.

In this manner all corners of the figure are denoted in turn to provide the polygon of a given number of sides as determined by the apex angle.

6 Claims, 2 Drawing Figures

TEMPLATE FOR SCRIBING POLYGONS

BACKGROUND OF INVENTION

This invention relates to a template device and more particularly to a template structure useful for the drafting of multi-sided figures such as polygons.

There are many patents shown in the prior art which provide various types of drafting instruments to enable a user to accurately scribe or form complicated geometrical figures.

For example, U.S. Pat. No. 1,615,180 entitled GEOMETRICAL DEVICE by G. B. Stewart issued on Jan. 18, 1927. This patent describes a template device for providing multi-sided figures. In implementing the construction of such figures, the device uses a series of different triangles which are used to create a desired geometrical shape.

U.S. Pat. No. 2,637,110 entitled DRAFTING INSTRUMENT by H. S. Gilbertson issued on May 5, 1953. This patent also shows a drafting aid which is used to construct triangles and other geometrical figures. The device has a series of apertures to enable rotation of the device during a construction procedure.

U.S. Pat. No. 3,766,654 entitled STARGUIDE DRAWING INSTRUMENT issued on Oct. 23, 1973 to S. Canton. This patent is a template which can operate to provide a number of geometrical forms and operates in conjunction with a trapezoidal insert to produce such forms.

Other patents such as U.S. Pat. No. 3,795,053 and U.S. Pat. No. 4,026,030, show different devices which are used as drafting aids to provide a multitude of different forms.

Based on the above, it is of course understood that the use of templates of various structures and configurations is widespread and the prior art is fully cognizant of such devices which are employed to facilitate the drawing and construction of complicated figures. A particular application of this particular template resides in the production of mattes for picture framing. As is well-known, a picture or painting which is to be framed is usually surrounded by a matte which forms a border for the picture. As such, most mattes provided have a picture frame apearance and are rectangular or square in shape. For aesthetic purposes it would be extremely desirable to provide a matte configuration which possessed a polygonal shape.

In this manner the user of the template can produce mattes or geometrical figures which encompass 5 or more symmetrical sides. It is of course understood that the drafting of such figures is extremely difficult and may be well beyond the capabilities of many individuals such as those who construct and mount pictures with accompanying mattes. It is therefore an objective of the present invention to provide a series of templates, all of which operate on the same priciples and which, based on the structure, are capable of enabling a user to provide polygonal structures with a minimum of effort and in a rapid and reliable manner.

BRIEF DESCRIPTION OF THE PREFERRED EMBODIMENT

A template for scribing polygons comprising a planar member having an apex at one end with a right and left side extending therefrom at the same given angle with respect to a horizontal line, a first right slot on the surface of said member positioned above said right side and extending parallel thereto, and a second left slot positioned on the surface of said member above said left side and extending parallel thereto, said planar planar member having on its surface a series of indicators directed along a vertical axis emanating from said apex and positioned symmetrically between said slots to determine rotation points for said template when a pivot member is inserted at a selected one of said indicators indicative of the length of a side of said polygon to be formed.

DETAILED DESCRIPTION OF THE FIGURES

Figure 1:
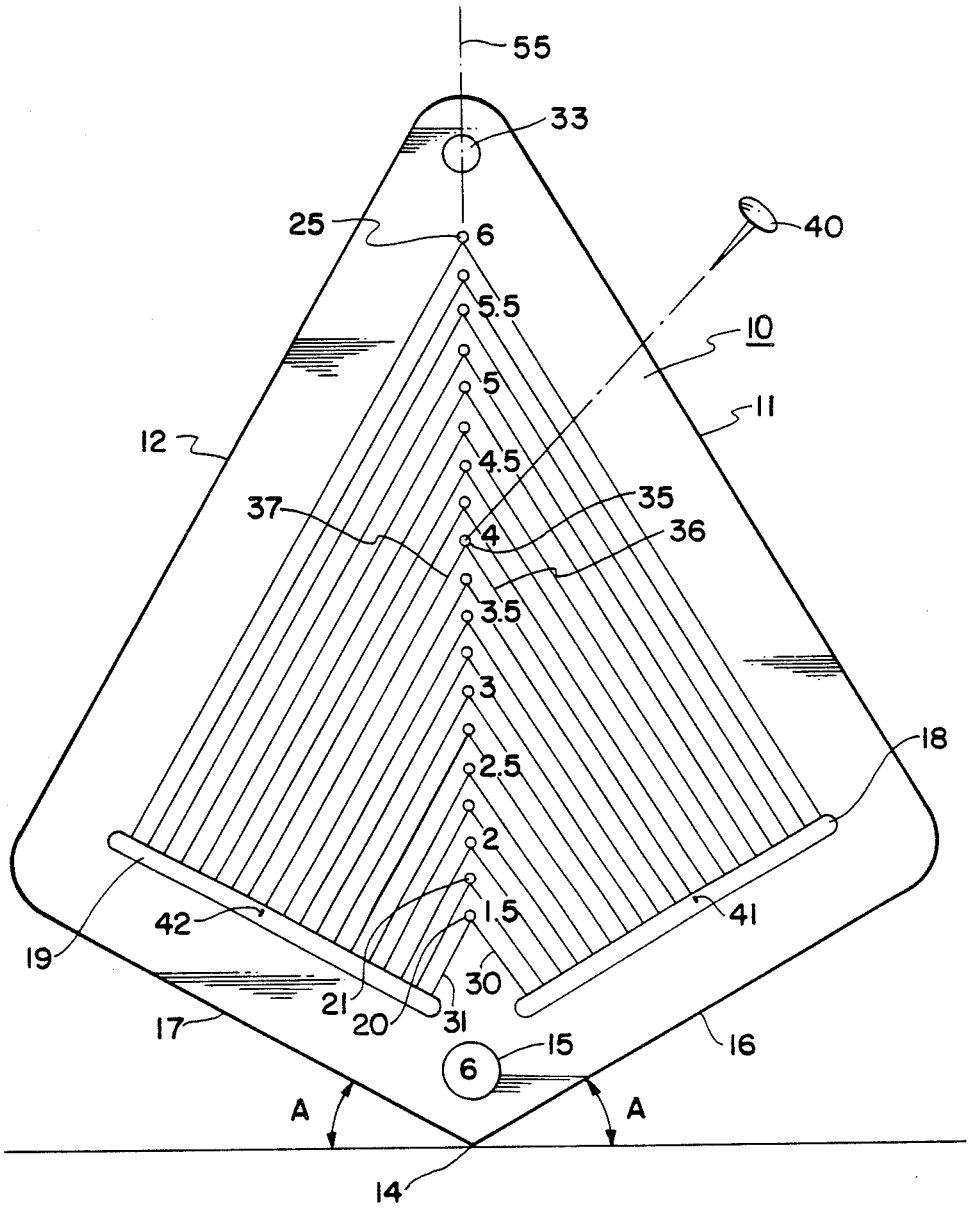
FIG. 1 is a top plan view of a template according to this invention for providing a 6-sided figure.

Before proceeding with a description of FIG. 1, it is noted that the template to be described is capable of producing a multi-sided figure and that corresponding templates of similar structure and design will provide polygons of different shapes.

Referring to FIG. 1, there is shown a template which is representative of other templates according to this invention. The template depicted in FIG. 1 is capable of permitting a user to provide symmetrical 6-sided figures or hexagons. The provision of the hexagon is implemented in a simple and rapid manner according to the method as will be described.

The template 10 depicted in FIG. 1 is a planar member having sloping side walls 11 and 12 with a bottom apex 14 positioned at the center line of the template. The template shown in FIG. 1 is capable of providing, as indicated, a 6-sided figure and, therefore, the numeral 6 is imprinted upon the template by a suitable technic as shown by reference numeral 15.

The template 10 may be fabricated from a plastic or other suitable material as is known in the art, such as those materials used presently to construct and implement template structures.

The apex 14 has left and right sides 16 and 17 extending therefrom, each side being at the same given angle A, which angle is 30 degrees for providing a 6-sided figure. Shown parallel to the sides 16 and 17 are a right and a left slot, 18 and 19. The slots 18 and 19 are parallel to the respective sloping sides 16 and 17. Arranged along the vertical central axis of the template structure are a series of apertures as 20, 21, and 25. Each aperture is positioned on the vertical axis at 1/4 inch intervals with aperture 20 being 1.5 inches from apex 14.

As can be seen, adjacent respective apertures are the numerals 1.5 to 6. These numerals designate the length of each side of the hexagon to be constructed using the template. Directed from each aperture, as 20, 21 and so on, is a line which is directed according to angle A towards the corresponding slots as 18 and 19. Thus, as one can see from FIG. 1, there is a line 30 which runs from aperture 20 to the slot 18 and corresponding line 31 directed from aperture 20 to the slot 19. The angle A is shown on the drawing. Thus, as seen from the figure, the angle A is also the angle at which the center line of slots 18 and 19 intersect the vertical central axis 55 of the template.

There is also shown an aperture 33 which is used to hold the device on a wall or similar structure when not in use, as for hanging the device.

When using the template depicted in FIG. 1, the following operations are employed:

The user inserts a tack or a pin through an aperture as 20, 21, 25, etc. This determines the size of the side of the hexagon to be formed by the template 10. For example, if a hexagon of 4 inch sides is to be provided, the user would insert a pin or tack into aperture 35 to allow the entire template to pivot about this point. The user will then follow the lines 36 and 37 which are directed from aperture 35 to slots 18 and 19. As can be seen from FIG. 1, each aperture, as 35, is associated with a first line 36 and a second line 37, which are imprinted on the surface of template 10 and are directed to the corresponding slots, as 18 and 19. The lines 36 and 37 are perpendicular to the center line of the slot or to the edges of the slot and are drawn as shown at a slope completely determined by the angle A as can be seen from the geometrical construction of the template.

He will then mark this position in each of the slots. With these marks, he will then use the sides 16 and 17 to scribe the first corner of the hexagon. As indicated, the pin or tack 40 which is inserted into aperture 35 is left in position. The template 10 is then rotated in the counter clockwise direction so that line 37 is now aligned with the mark 41 made in slot 18. At this position the next corner is then scribed using sides 16 and 17. The above noted process continues until all sides have been scribed.

The user may now remove the tack and complete the lines by connecting the same to complete a perfect hexagon structure.

While the above description indicates rotation in the counter clockwise direction, the same exact effect can be accomplished by rotating the template in the clockwise direction and thereby alinging line 36 with the mark 42 associated with slot 19.

Figure 2:
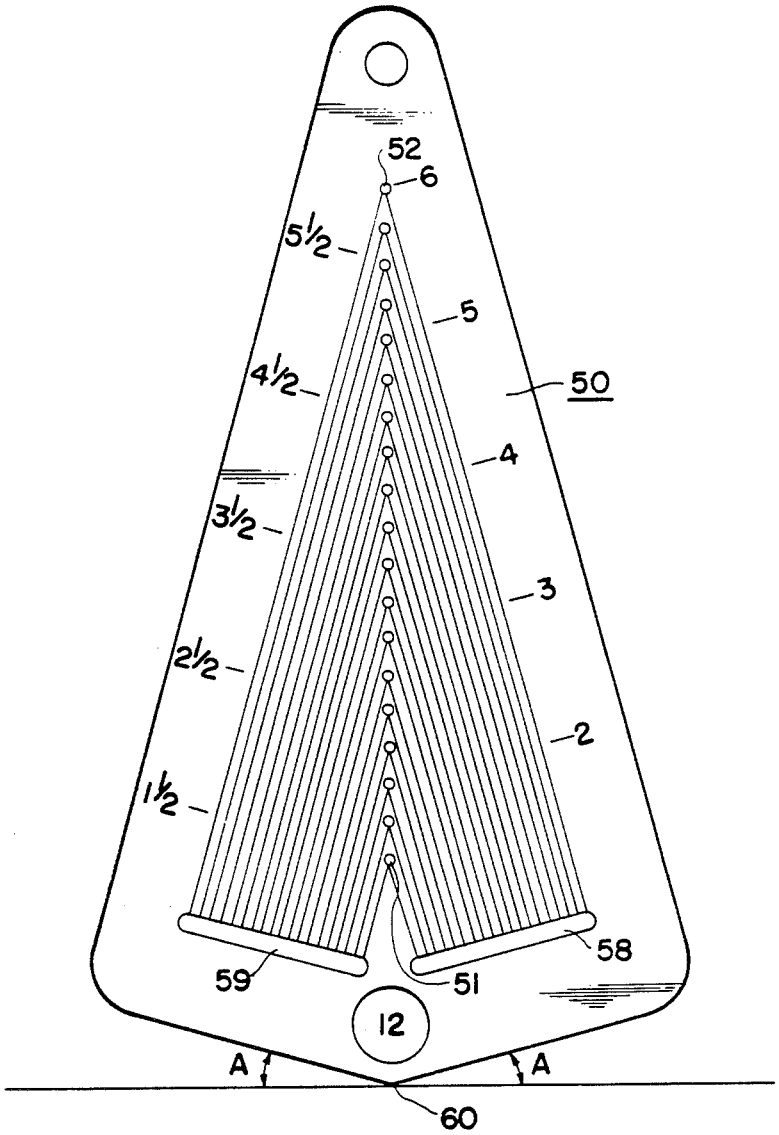
FIG. 2 is a top plan view of a template according to this invention for providing a 12-sided polygon.

Referring to FIG. 2, there is shown a template configuration for providing a 12-sided polygonal structure.

Again, the template 50 of FIG. 2 has a series of apertures between apertures 51 and 52 which are separated one from the other by ¼ inch to enable the construction of 1.5 to 6 inch sided figures. It has slots 58 and 59 with an apex 60 arranged at an angle A of 15 degrees. The template is used in the same exact manner for construction of polygons having sides of 1 to 6 inches.

It is of course understood that the principles above described can be employed to produce polygons having sides of anywhere from 1 to 12 inches or more depending strictly upon the spacing of the apertures as 51 and 52 from the apex 60 of the unit. The following table designates the angle A necessary to provide a template to produce the number of sides indicated. It is of course understood that each of the templates will be of the same configuration as the template shown in FIG. 1 and FIG. 2 and are implemented and operated in the same exact manner to produce polygons having the number of sides indicated with each template differing by the angle A.

| NUMBER OF SIDES | ANGLE A |
|---|---|
| 5 | 36° |
| 6 | 30° |
| 7 | 25.714286° |
| 8 | 22.5° |
| 9 | 20° |
| 10 | 18° |
| 11 | 16.363636° |
| 12 | 15° |

As can be seen from the above table the angle A is determined according to the following formula:

$$A=(360°/2n)$$

n=number of sides of the polygon

The template shown in FIG. 1 has four sides with sides 11 and 12 also being sloped for aesthetic purposes. It is understood that these sides do not have to be sloped but can be of any configuration as long as sides 16 and 17 are directed from apex 14 at the proper opposing slopes determined by the angle A. Preferably the template 10 should be fabricated from a transparent plastic to enable efficient use and to allow the user to quickly determine the completion of the corners of the polygon under construction.

I claim:

1. A template for scribing polygons comprising:

a planar member having an apex at one end with a right and left side extending therefrom at the same given angle A with respect to a horizontal line, a first right slot on the surface of said member positioned above said right side and extending parallel thereto, and a second left slot positioned on the surface of said member above said left side and extending parallel thereto, said planar member having on its surface a series of indicators directed along a vertical axis emanating from said apex and positioned symmetrically between said slots to determine rotation points for said template when a pivot member is inserted at a selected one of said indicators indicative of the length of a side of said polygon to be formed, where the said given angle A is selected such that $$A=(360°/n)$$

where n=number of sides of said polygon to be formed.

2. The template according to claim 1, further including a series of lines imprinted on said planar member with one line directed from a given aperture to said right slot and another line directed from said aperture to said left slot at a slope determined by said given angle A.

3. The template according to claim 1, wherein said indicators are a plurality of apertures spaced one from the other according the length of a side of said polygon.

4. A template for scribing polygons comprising:

a 4-sided planar member symmetrically disposed about a vertical central axis, with first and second sides directed from a top apex at said vertical central axis and extending downwardly therefrom at the same angle from said apex with opposite slopes, third and fourth sides extending from a bottom apex at said vertical central axis and extending upwardly therefrom at a given angle A of opposite slope to intersect said first and second sides, a first and second slot, each one parallel to and associated with one said third and fourth sides, and a plurality of indicators arranged at predetermined intervals on said planar member and along said vertical axis to provide points of rotation for said planar member, wherein said given angle A is determined by A=(360°/n) where n=number of sides of said polygon to be scribed.

5. The template according to claim 4, wherein said indicators are a plurality of apertures adapted to receive a pivot member to allow said template to rotate about any one of said apertures as selected.

6. The template according to claim 4, wherein said indicators are arranged at predetermined intervals manifesting the length of a side of said polygon.

* * * * *